US009193510B2

(12) United States Patent
Mohammed et al.

(10) Patent No.: US 9,193,510 B2
(45) Date of Patent: Nov. 24, 2015

(54) SYSTEMS AND METHODS FOR HEATING LIQUID, SEMI-SOLID OR LIQUID/SOLID COMBINATION COMESTIBLES IN COMBINATION MICROWAVE AND CONVECTION OVENS

(75) Inventors: Rasheed Mohammed, Sicklerville, NJ (US); Adrienne Lynn Sienkowski, Phoenixville, PA (US); Talia Salamon-Hickey, Marlton, NJ (US); Mohammed Karkache, Deptford, NJ (US); Mark R. Watts, Marlton, NJ (US); Amanda Zimlich, Media, PA (US); Allan Sinclair, Cambridge (GB); Chris Dawson, Cambridge (GB); James Howarth, Cambridge (GB); William Cramer, Cambridge (GB)

(73) Assignee: Campbell Soup Company, Camden, NJ (US)

( * ) Notice: Subject to any disclaimer, the term of this patent is extended or adjusted under 35 U.S.C. 154(b) by 913 days.

(21) Appl. No.: 13/246,016

(22) Filed: Sep. 27, 2011

(65) Prior Publication Data

US 2013/0075391 A1 Mar. 28, 2013

(51) Int. Cl.

| | |
|---|---|
| ***H05B 6/80*** | (2006.01) |
| ***B65D 75/00*** | (2006.01) |
| ***B65D 81/34*** | (2006.01) |

(Continued)

(52) U.S. Cl.

CPC ..... *B65D 75/008* (2013.01); *B65D 43/162* (2013.01); *B65D 77/02* (2013.01); *B65D 81/3446* (2013.01); *H05B 6/6408* (2013.01); *B65D 33/2508* (2013.01); *B65D 2205/00* (2013.01)

(58) Field of Classification Search

CPC ..... A47J 36/027; B65D 81/3446; B65D 81/3453; B65D 81/3461

USPC ..... 219/725, 730–735

See application file for complete search history.

(56) References Cited

U.S. PATENT DOCUMENTS 4,140,889 A * 2/1979 Mason et al. ..... 219/733
5,464,969 A * 11/1995 Miller ..... 219/735

(Continued)

FOREIGN PATENT DOCUMENTS

WO 2013048894 4/2013

OTHER PUBLICATIONS

Excelsior Technologies Ltd UK website (http://www.exceltechuk.com/productspouches.

(Continued)

*Primary Examiner* — Dana Ross
*Assistant Examiner* — Brandon Harvey
(74) *Attorney, Agent, or Firm* — Pauly, DeVries, Smith & Deffner, L.L.C.

(57) ABSTRACT

A system is provided for heating a comestible. The system includes a container and a flexible vented package containing a liquid, semi-solid or liquid/solid combination comestible. The package is positioned within the container in a manner that hinders the comestible from escaping through the package's vent(s). The container is penetrable to microwaves and is adapted to not experience heat-induced damage when subjected to a heating cycle in a combination microwave and convection oven. The container is adapted to protect the package from heat-induced damage when the container is subjected to a heating cycle in a combination microwave and convection oven.

17 Claims, 5 Drawing Sheets

(51) Int. Cl.

| | |
|---|---|
| ***H05B 6/64*** | (2006.01) |
| ***B65D 77/02*** | (2006.01) |
| ***B65D 43/16*** | (2006.01) |
| *B65D 33/25* | (2006.01) |

(56) References Cited

U.S. PATENT DOCUMENTS

| | | | | |
|---|---|---|---|---|
| 6,262,406 | B1 | 7/2001 | McKee et al. | |
| 6,414,288 | B1 | 7/2002 | Bono et al. | |
| 6,486,455 | B1 | 11/2002 | Merabet | |
| 6,952,000 | B2 | 10/2005 | Ohyama | |
| 2004/0238535 | A1 | 12/2004 | Mast | |
| 2007/0012755 | A1 | 1/2007 | Metcalf | |
| 2009/0039076 | A1 | 2/2009 | Maslowski et al. | |
| 2009/0078698 | A1 | 3/2009 | Middleton et al. | |
| 2010/0129503 | A1 | 5/2010 | Flaherty | |
| 2010/0218690 | A1* | 9/2010 | Huber et al. | 99/451 |
| 2010/0266732 | A1 | 10/2010 | Thomas | |
| 2011/0174870 | A1* | 7/2011 | Owensby et al. | 229/117.12 |
| 2014/0348990 | A1 | 11/2014 | Mohammed et al. | |

OTHER PUBLICATIONS

Turbochef Product Brochure website (http://www.turbochef.com/filemanager/7/Product_Brochure.pdf).

Printout from Walgreens website (http://www.walgreens.com/store/c/campbel's-soup-at-hand-soup/ID=prod1678818-product).

International Search Report dated Sep. 21, 2012.

* cited by examiner

SYSTEMS AND METHODS FOR HEATING LIQUID, SEMI-SOLID OR LIQUID/SOLID COMBINATION COMESTIBLES IN COMBINATION MICROWAVE AND CONVECTION OVENS

BACKGROUND OF THE INVENTION

1. Field of Invention

This invention relates to products and methods for heating comestibles. More particularly, this invention relates to containers and packages that may be used to heat liquid, semi-solid or liquid/solid combination comestibles, e.g., in combination microwave and convection ovens.

2. Description of Related Art

Soups, sauces, chilis, and other such liquid, semi-solid or liquid/solid combination comestibles are often served in eating establishments, e.g., restaurants and cafeterias. Many eating establishments, especially quick service restaurants (QSR), do not prepare such foods from scratch. Rather, eating establishments often heat up ready-made liquid, semi-solid or liquid/solid combination comestibles that were previously prepared and cooked by comestible manufacturers. These comestibles are often packaged and stored at room temperature or are refrigerated or frozen until they are ready to be heated and served.

Eating establishments may use any of a number of different modalities to heat liquid, semi-solid or liquid/solid combination comestibles. For example, large amounts of soup are often heated at one time in a large pot on a stove or warmer and then transferred to soup bowls, one serving at a time. However, heating a large amount of soup takes a long time. Often, the soup is maintained at a hot temperature for hours until all of it is served or any remaining portion is disposed of. The result is an over-cooked product, much of which goes to waste. In addition, the pot, utensils and soup bowls (unless disposable) will need to be cleaned after use. While microwave ovens may be used to heat such comestibles, a significant number of eating establishments, especially in the QSR segment, do not have microwave ovens.

Increasingly, eating establishments are using combination microwave and convection ovens, such as those sold under the trademark TURBOCHEF®, to cook or reheat essentially solid comestibles. Combination microwave and convection ovens use both microwave energy and convection heating to enable rapid and convenient cooking and heating of comestibles. For example, such ovens can quickly warm hoagies and grinders, leaving the bread crispy rather than soft or soggy, as would be the likely result using a microwave oven alone.

Notwithstanding their increasing popularity in eating establishments, combination microwave and convection ovens are not used to heat liquid, semi-solid or liquid/solid combination comestibles because there are currently no feasible means to do so, especially in the QSR setting. Typical microwaveable cookware, such as ceramics, glass, PYREX®, foams, ovenable plastics, or ovenable paper/paperboard, are not practical and in some cases unsuitable for heating soups and the like in combination microwave and convection ovens. Disposable containers made from ovenable paper/paperboard, ovenable plastic and foam can only be used in ambient temperatures of up to about 400° F. Those materials will melt or burn if subjected to the ambient environment of a combination microwave and convection oven, which typically holds at 480° F. or above all day in an eating establishment (especially in a QSR). Thus, while disposable materials are convenient in that they allow for little to no cleanup after use, currently available disposable containers are unfit for direct use in combination microwave and convection ovens.

Ceramics, glass and PYREX®, on the other hand, can withstand ambient temperatures in a combination microwave and convection oven. However, those materials retain a significant amount of heat. Consequently, they can be extremely hot to the touch. In addition, heating comestibles directly in containers made from such reusable materials would require that the containers be cleaned after use. Accordingly, ceramic, glass and PYREX® cookware are inconvenient for an operator to use for heating soups and the like in combination microwave and convection ovens, especially in a QSR setting, where the operator works under tight time constraints. Also, heating soup and the like directly in ceramic, glass or PYREX® cookware in a combination microwave and convection oven can burn or scorch the soup due to the extremely high temperatures in such an oven. Thus, ceramic, glass and PYREX® cookware are not feasible options for an operator, especially in a QSR setting, to deliver a quality product with convenience and speed using a combination microwave and convection oven.

In short, many eating establishments have combination microwave and convection ovens and serve hot liquid, semi-solid or liquid/solid combination comestibles. But such eating establishments tend not to use such ovens to heat such comestibles because there are no practical and disposable means to do so. This is indeed surprising, considering that combination microwave and convection ovens have been commercially available for many years and have greatly increased in popularity in recent years. Accordingly, there is a need for practical systems and methods that enable liquid, semi-solid or liquid/solid combination comestibles to be heated in combination microwave and convection ovens. Such systems and methods should enable rapid and substantially uniform heating of the comestible in a manner that is convenient and would require little to no cleanup. Preferably, such systems and methods would be used for heating single-serving packages of liquid, semi-solid or liquid/solid combination comestibles. More preferably, such systems and methods would provide thermal protection to a single-serve comestible-containing disposable package so that the package can withstand the high ambient temperatures (e.g., 480° F. to 540° F.) in a combination microwave and convection oven.

BRIEF SUMMARY OF THE INVENTION

Accordingly, there is provided a system for heating a comestible. The system includes a container and a flexible vented package containing a liquid, semi-solid or liquid/solid combination comestible. The package is positioned within the container in a manner that hinders the comestible from escaping through the package's vent(s). The container is penetrable to microwaves and is adapted to not experience heat-induced damage when subjected to a heating cycle in a combination microwave and convection oven. The container is adapted to protect the package from heat-induced damage when the container is subjected to a heating cycle in a combination microwave and convection oven.

In another aspect, there is provided a method of heating a comestible. The method includes subjecting a system to a combination microwave and convection oven heating cycle to heat contents within the system. The system includes a closed container and a flexible package containing a comestible. The package is located within the container. The container is penetrable by microwaves and prevents heat-induced damage to the package during the heating cycle.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
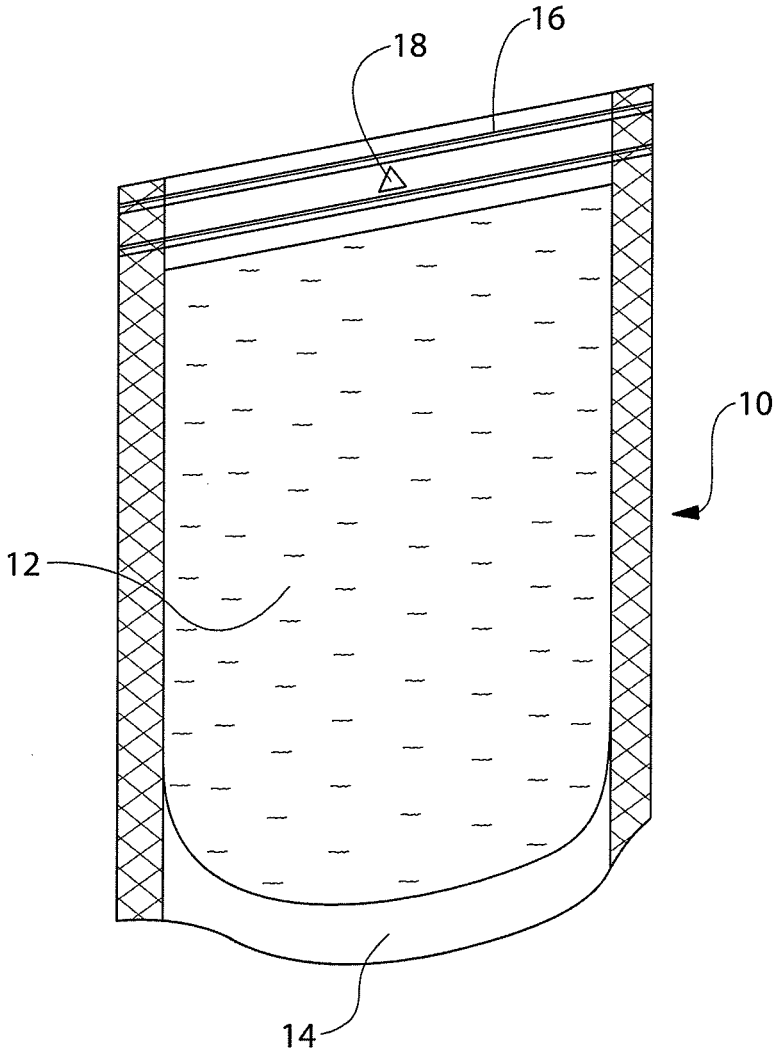
FIG. 1 is an isometric view of a vented flexible package containing an essentially liquid comestible.

Referring now in detail to the various figures of the drawings wherein like reference numerals refer to like parts, there is shown in FIG. 1 a flexible package 10 containing an essentially liquid comestible 12, e.g., soup. The essentially liquid comestible can be a liquid, a semi-solid or a liquid/solid combination and may, prior to heating, be frozen, refrigerated or at about room temperature. The package 10 is preferably a pliable and disposable plastic vented pouch, such as a multilayer polymer-based (e.g., PET/CPP) pouch. A preferred package 10 is the pouch sold by Excelsior Technologies Ltd. under the trademark SYSTEAM®. Although the flexible package 10 may be configured to hold several servings of comestible, it is preferred that the package 10 is configured to hold only one serving. The size of one serving can vary depending on the nature of the comestible (e.g., one serving of sauce is typically a smaller amount than one serving of chili or soup). For example, one serving may be anywhere from 1 fl. oz. to 20 fl. oz. But preferably, the package 10 holds from 8 fl. oz. to 12 fl. oz. of comestible and more preferably about 9 fl. oz. to 10 fl. oz. of comestible. In addition, the package 10 should be simple for a user to manually open in order to retrieve the contents therein after heating. For example, the package 10 may include tear notches that enable the user to propagate a tear along a top portion of the package 10.

When filled with comestible 12, the package 10 has a wider bottom portion 14 which tapers to a narrower top portion 16. Near the top portion 16 is a vent 18 that is preferably adapted to provide controlled release of steam and hot air. More preferably, the vent 18 is temperature-sensitive or pressure-sensitive, i.e., it is adapted to open upon either the internal temperature of the package 10 reaching a predetermined level or the internal pressure of the package reaching a predetermined level during heating. For example, the vent may open upon the comestible reaching a temperature of from about 155° F. to about 175° F. or when the package inflates during heating due to increased internal pressure. Alternatively, the vent 18 is a factory-made or user-made opening that is open throughout the heating process. Regardless of the particular embodiment, the vent 18 allows for venting of steam and hot air when the package 10 and comestible 12 are heated.

Figure 2:
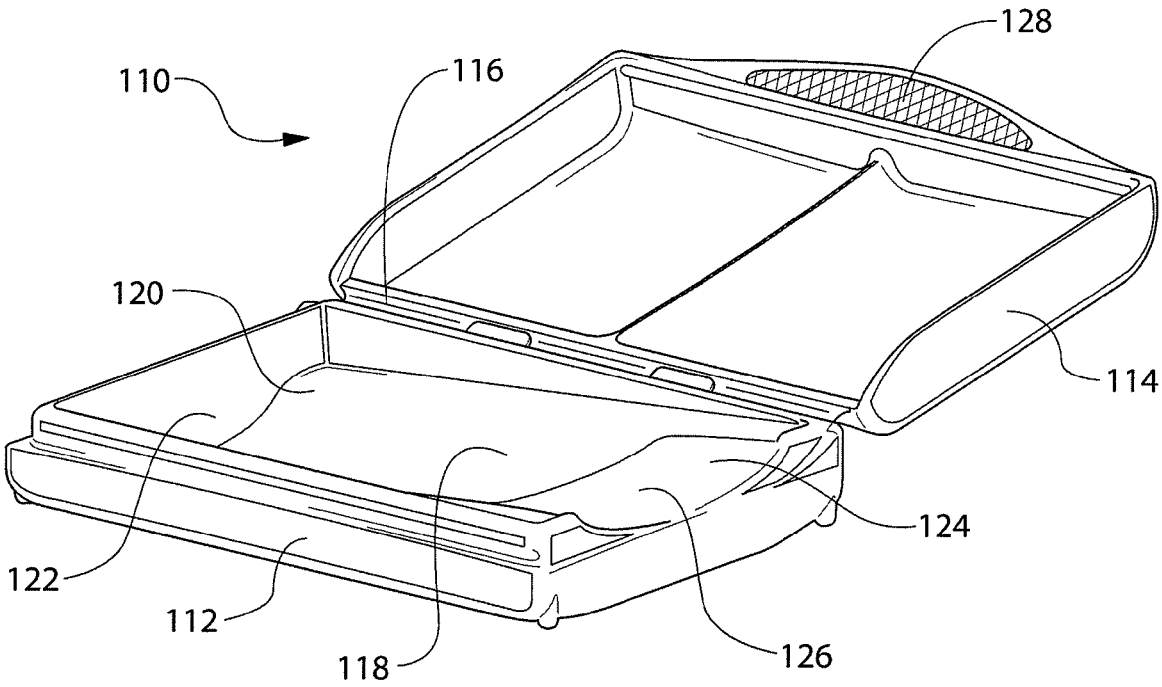
FIG. 2 is an isometric view of a container of the present invention in an open position.

Referring now to FIG. 2, there is shown an isometric view of a container 110 of the present invention in an open position. The container 110 is in the form of a clamshell. While other container forms are contemplated (e.g., containers with separate, removable lids), a clamshell is preferred, among other reasons, because the unitary design prevents a user from losing the lid. The container 110 is preferably made from a high temperature polymer. The high temperature polymer should resist heat-induced damage at ambient temperatures commonly used in a combination microwave and convection oven heating cycle, e.g., from 480° F. to 540° F. The container 110 should also be penetrable by microwaves. Ideally, the container should be made from a durable, reusable material that is capable of being subjected to numerous heating cycles (preferably hundreds or thousands of such cycles) in a combination microwave and convection oven without experiencing heat-induced damage or wear (e.g., burning, melting, warping, etc.). Silicone is a preferred material for the container 110. TEFLON® is also suitable, but other materials that meet the foregoing criteria would suffice.

Figure 3:
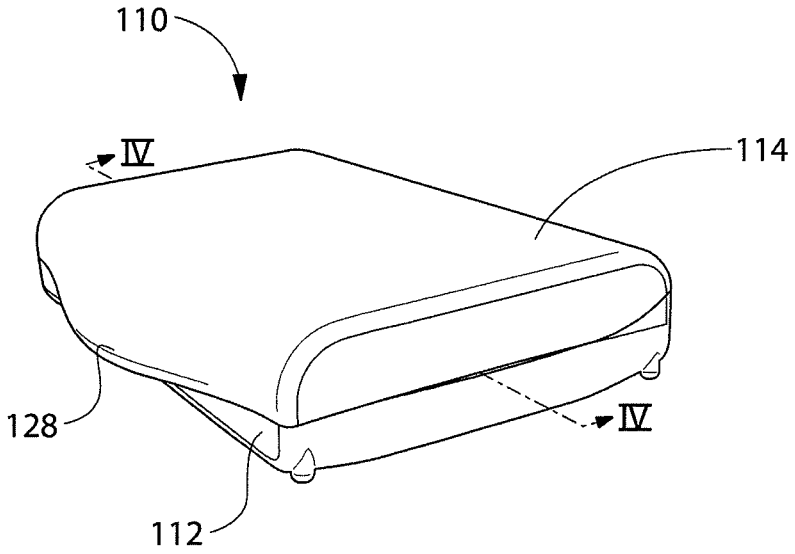
FIG. 3 is an isometric view of the container of FIG. 2 in a closed position.

The container 110 includes a base portion 112 and a lid portion 114 pivotally connected thereto by a hinge 116. The hinge 116 enables angled lifting and lowering of the lid portion 114 relative to the base portion 112, i.e., to open and close the container 110. The base portion 112 includes an inner compartment 118 adapted to hold the flexible package 10 of FIG. 1. The inner compartment 118 comprises an angled surface 120 that slopes upwards from a first side 122 towards a second side 124 of the inner compartment 118. The angled surface 120 transitions to an indented surface 126 adjacent to the second side 124 of the inner compartment 118. The indented surface 126 is preferably concave or otherwise configured so as to provide a finger well area to facilitate easy lifting of the package 10 from the container 110 after heating. The lid portion 114 also comprises a handle 128 to enable a user to easily open and close the container 110. FIG. 3 is an isometric view of the container 110 in a closed position.

Figure 4:
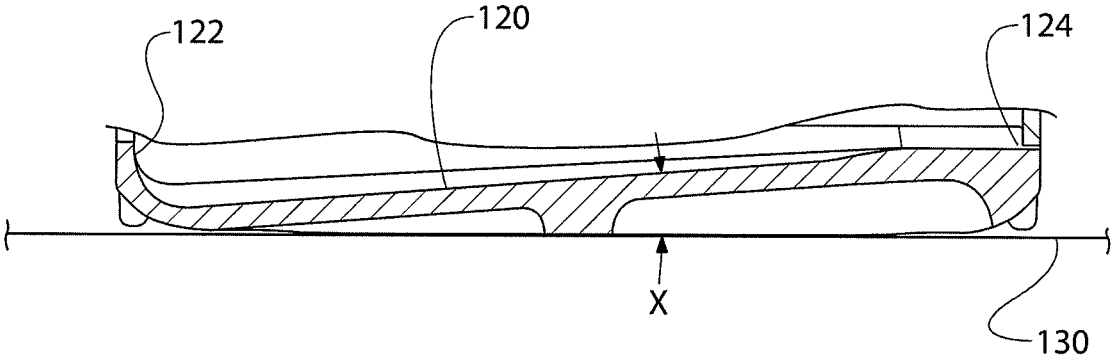
FIG. 4 is a simplified partial sectional view of the container along the plane defined by section line IV-IV of FIG. 3.

Referring now to FIG. 4, there is shown a partial simplified sectional view of the container 110 along the plane defined by section line IV-IV of FIG. 3. The angled surface 120 has an angle X, which represents the angular measurement between the angled surface 120 and a horizontal plane, e.g., a horizontal surface 130 supporting the container 110 (e.g., an oven rack). The value of X can conceivably range anywhere from greater than 0° to less than 90°. The value of X may vary depending on the dimensions of the inner compartment 118 and the dimensions of the flexible package 10 that the inner compartment 118 is adapted to hold. However, it is contemplated that X should generally be from 5° to 45°, and more preferably about 30°.

Figure 5:
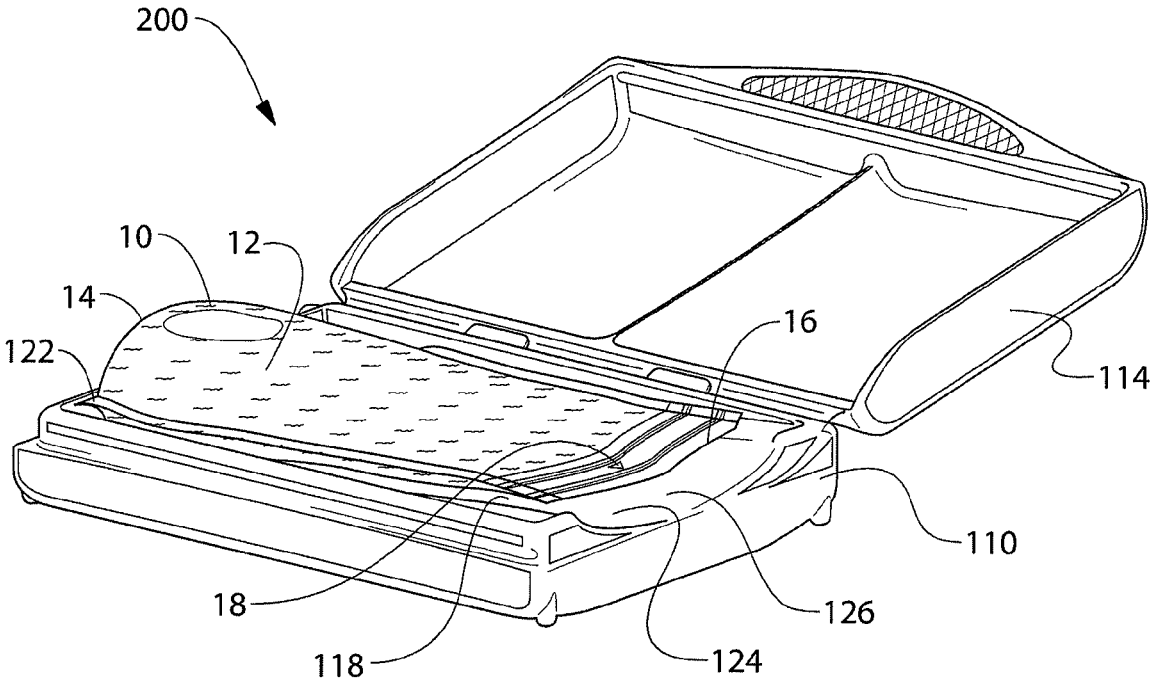
FIG. 5 is an isometric view of the container of FIG. 2 with the vented flexible pouch of FIG. 1 positioned therein.

Referring now to FIG. 5, there is shown an isometric view of a system 200 for heating a comestible. The system 200 comprises the container 110 of FIG. 2 and the flexible package 10 of FIG. 1 positioned therein. More specifically, the package 10 is positioned within the inner compartment 118 of the base portion 112 of the container 110. The package 10 rests on the angled surface 120 with the vent 18 facing up. The bottom portion 14 of the package 10 is positioned adjacent to the first side 122 of the inner compartment 118 and the top portion 16 of the package 10 is positioned adjacent to the second side 124 of the inner compartment 118. Thus, the package 10 is oriented at a slight angle in the inner compartment 118. This angular orientation helps to prevent the comestible 12 from flowing towards the top portion 16 of the package 10. In this way, the comestible 12 is hindered (i.e., at least substantially prevented) from escaping through the vent 18. At the same time, the comestible 12 is maintained at a substantially uniform thickness in the package 10 so as to better facilitate quick and uniform heating of the comestible 12. Preferably, the comestible 12 in the package 10 is maintained at an average thickness of approximately one inch or less. More preferably, the comestible 12 is maintained at an average thickness of 0.25 inches to 0.75 inches. Most preferably, the comestible 12 is maintained at an average thickness of 0.5 inches or less.

Once the package 10 is placed in the container 110 as shown in FIG. 5, the container 110 may then be closed as shown in FIG. 3 and placed in an oven, e.g., a combination microwave and convection oven, for heating. A typical heating cycle in a combination microwave and convection oven according to the present invention is ninety seconds or less at an ambient oven temperature of from 480° F. to 540° F.

After a heating cycle in the oven is complete, the container 110 may be opened again as shown in FIG. 5. A user may then manually grasp the top portion 16 of the package 10 to lift and remove the package 10 from the inner compartment 118 of the container. The indented surface 126 adjacent to the second side 124 of the inner compartment 118 provides space for a user to grasp the top portion 16 of the package 10. Also, the top portion 16 of the package 10 would preferably be isolated from the comestible 12 and cool enough for a user to touch (e.g., 150° F. or less) with bare hands after a heating cycle. After the user removes the package 10, he or she may then manually open the package 10 and empty the comestible 12 into a bowl or the like for serving. It is contemplated that the user would dispose of the package 10 after a single use but be able to reuse the container 110 for potentially hundreds or thousands of heating cycles.

Cooking times in a combination microwave and convection oven may vary based on a number of factors, including at least the power of the oven, the amount of comestible being heated, the starting temperature of the comestible and the desired serving temperature of the comestible. However, it is generally contemplated that the system 200 should enable the heating of 8 fl. oz. to 12 fl. oz. of liquid, semi-solid or liquid solid combination comestible from 35° F.-55° F. to 155° F.-175° F. in a combination microwave and convection oven in ninety seconds or less. More preferably, the system 200 would accomplish such heating in one minute or less. In short, the system 200 should enable quick and substantially uniform heating of single servings of refrigerated soups and the like in a combination microwave and convection oven. The system 200 should also prevent heat-induced damage to the package 10 and the comestible 12. Additionally, the system 200 should achieve these objectives in a way that leaves the container 110 clean after use.

Although the inner compartment 118 of the container 110 comprises an angled surface 120 as shown in the drawing figures, it is contemplated that a system according to the present invention may comprise a flat resting surface for a comestible-containing flexible package. Whichever way the container is configured, it should be adapted to position the flexible package in a manner that hinders the comestible from escaping through the package's vent(s). Thus, the container may be configured differently depending on the shape of the package and/or location of the package's vent(s).

The invention will be illustrated in more detail with reference to the following Examples, but it should be understood that the present invention is not deemed to be limited thereto.

EXAMPLES

Example 1

Twenty-six comestible heating experiments were conducted. For each experiment, a disposable vented plastic pouch containing about 250 grams of soup was placed into a high temperature polymer container. Next, the container/pouch combination was heated (one at a time) in a TURBO-CHEF® brand combination microwave and convection oven. The soups varied in terms of broth viscosity and solid ingredients (if any) that were contained in the broth. The following chart summarizes relevant data recorded about each experiment.

| Experiment No. | Container Material | Heating Time (seconds) | Initial Temp. (deg. F.) | Final Temp. (deg. F.) |
|---|---|---|---|---|
| 1 | TEFLON ® | 60 | 75 | 150 |
| 2 | TEFLON ® | 45 | 75 | 140 |
| 3 | TEFLON ® | 60 | 75 | 165 |
| 4 | TEFLON ® | 60 | 80 | 160 |
| 5 | TEFLON ® | 60 | 74 | 175 |
| 6 | TEFLON ® | 60 | 75 | 177 |
| 7 | TEFLON ® | 45 | 75 | 140 |
| 8 | TEFLON ® | 45 | 75 | 160 |
| 9 | TEFLON ® | 60 | 65 | 165 |
| 10 | TEFLON ® | 60 | 57 | 135 |
| 11 | TEFLON ® | 60 | 67 | 140 |
| 12 | TEFLON ® | 75 | 67 | 180 |
| 13 | TEFLON ® | 50 | 72 | 162 |
| 14 | TEFLON ® | 60 | 40 | 125 |
| 15 | silicone | 60 | 39.5 | 169 |
| 16 | silicone | 60 | 40 | 155 |
| 17 | silicone | 60 | 55 | 171 |
| 18 | silicone | 60 | 55 | 145-150 |
| 19 | silicone | 60 | 55 | 145-150 |
| 20 | silicone | 60 | 55 | 155-160 |
| 21 | silicone | 60 | 55 | 160 |
| 22 | silicone | 60 | 55 | 160 |
| 23 | silicone | 60 | 55 | 155 |
| 24 | silicone | 60 | 40 | 195 |
| 25 | silicone | 60 | 40 | 195 |
| 26 | silicone | 60 | 48 | 162-163 |

As the data in the foregoing chart illustrates, single-servings of soup were heated, using systems and methods of the present invention, in a combination microwave and convection oven. Each serving was heated from refrigerated or room temperatures to hot serving temperatures, generally in one minute or less. These results demonstrate that with the present invention, a user can now quickly and conveniently heat liquid, semi-solid or liquid/solid combination comestibles using a combination microwave and convection oven.

Had the pouch been placed directly into the oven without the thermal protection provided by the high temperature polymer container, the pouch would have rapidly deformed due to the high ambient temperature inside the oven. Had the soup simply been heated directly in the container, the container would have needed to be washed after use—a step that would detract from the convenience and speed that is especially required in a QSR setting. In addition, heating soup directly in the container would likely result in less predictable heating times, less predictable final temperatures and lack of temperature uniformity of the soup in the container. Use of a pouch allows the soup to spread so as to facilitate quick and uniform heating without dirtying the container.

While the invention has been described in detail and with reference to specific examples thereof, it will be apparent to one skilled in the art that various changes and modifications can be made therein without departing from the spirit and scope thereof.

What is claimed is:

1. A system for heating a comestible, the system comprising a container and a flexible package containing a liquid, semi-solid or liquid/solid combination comestible, the package having one or more vents, the package being positioned within the container in a manner that hinders the comestible from escaping through the one or more vents, wherein the container is in a form of a clamshell, the container being penetrable to microwaves, wherein the container comprises an inner compartment having a package-supporting bottom surface that is oriented at an angle greater than 0° relative to a horizontal surface supporting the container, wherein the container is adapted to not experience heat-induced damage when subjected to a heating cycle in a combination microwave and convection oven, the container being adapted to protect the package from heat-induced damage when the container is subjected to a heating cycle in a combination microwave and convection oven.

2. The system of claim 1, wherein the container is made from a polymer resistant to heat-induced damage at an ambient temperature of 540° F.

3. The system of claim 2, wherein the container is made from silicone.

4. The system of claim 1, wherein the container is adapted to not experience heat-induced damage when subjected to ambient temperatures of from 480° F. to 540° F.

5. The system of claim 1, wherein the one or more vents are adapted to open upon the comestible reaching a temperature of from about 155° F. to about 175° F.

6. The system of claim 1, wherein the container is closed.

7. The system of claim 1, wherein the comestible is maintained at an average thickness of one inch or less.

8. The system of claim 1, wherein the package-supporting surface is oriented at an angle of from 5° to 45° relative to the horizontal surface supporting the container.

9. The system of claim 1, wherein the package comprises a grasping portion that is isolated from the comestible, the grasping portion being adapted not to exceed 150° F. upon conclusion of a heating cycle in a combination microwave and convection oven.

10. The system for heating a comestible of claim 1, wherein the package-supporting bottom surface is an angled surface sloping upward from a first side toward a second side, the container further comprising an indented surface adjacent to the second side, the indented surface having a concave shape.

11. A method of heating a comestible, the method comprising placing a flexible package on a package-supporting surface of a clam shell container, the container comprising a lid portion, wherein the package-supporting surface is oriented at an angle of from 5° to 45° relative to a horizontal surface supporting the container, the flexible package having an top portion and a bottom portion when disposed on the package-supporting surface, the flexible package further comprising a vent disposed on the top portion of the flexible package;

closing the lid portion of the clam shell container to close the flexible package within the claim shell container;

subjecting the flexible package and clam shell container to a combination microwave and convection oven heating cycle to heat contents within the flexible package.

12. The method of claim 11, wherein the comestible is a liquid, semi-solid or liquid/solid combination.

13. The method of claim 11, the package containing 8 fl. oz.-12 fl. oz. of comestible, wherein the comestible is heated from 35° F.-55° F. to 155° F.-175° F. in 90 seconds or less.

14. The method of claim 13, wherein the comestible is heated from 35° F.-55° F. to 155° F.-175° F. in one minute or less.

15. The method of claim 11, wherein the package comprises a grasping portion that is isolated from the comestible, the grasping portion being adapted not to exceed 150° F. upon conclusion of the heating cycle.

16. The method of claim 11, wherein the comestible is maintained at an average thickness of one inch or less.

17. The method of claim 11 wherein the comestible has a substantially uniform temperature upon completion of the heating cycle.

* * * * *